US009976274B2

(12) United States Patent
Lipsker et al.

(10) Patent No.: US 9,976,274 B2
(45) Date of Patent: May 22, 2018

(54) GROUND ANCHOR SYSTEM AND METHOD

(71) Applicant: LIPSKER & CO. ENGINEERING SERVICES (1975) LTD., Kadima (IL)

(72) Inventors: Itzhak Lipsker, Ramat Hasharon (IL); Yoram Lipsker, Ramat Hasharon (IL); Boris Goldshlak, Bat Yam (IL)

(73) Assignee: LIPSKER & CO. ENGINEERING SERVICES (1975) LTD., Kadima (IL)

( * ) Notice: Subject to any disclaimer, the term of this patent is extended or adjusted under 35 U.S.C. 154(b) by 0 days. days.

(21) Appl. No.: 15/449,118

(22) Filed: Mar. 3, 2017

(65) Prior Publication Data

US 2017/0175353 A1 Jun. 22, 2017

Related U.S. Application Data

(63) Continuation of application No. 14/774,096, filed as application No. PCT/IL2014/050304 on Mar. 20, 2014, now Pat. No. 9,617,703.

(60) Provisional application No. 61/803,548, filed on Mar. 20, 2013.

(51) Int. Cl.
*E02D 5/80* (2006.01)

(52) U.S. Cl.
CPC ..... *E02D 5/80* (2013.01); *E02D 5/808* (2013.01); *E02D 2200/1628* (2013.01); *E02D 2220/00* (2013.01); *E02D 2250/0007* (2013.01); *E02D 2250/0046* (2013.01); *E02D 2300/002* (2013.01); *E02D 2600/30* (2013.01)

(58) Field of Classification Search
USPC ..... 405/259.1, 259.5, 302.4; 52/154, 223.4, 52/223.14
See application file for complete search history.

(56) References Cited

U.S. PATENT DOCUMENTS 4,000,623 A 1/1977 Meardi
4,666,345 A 5/1987 Seegmiller
(Continued)

FOREIGN PATENT DOCUMENTS

DE 2523988 12/1975
EP 0726383 8/1996
(Continued)

OTHER PUBLICATIONS

European Search Report from European Application No. 14771174 completed Jan. 29, 2016.
(Continued)

*Primary Examiner* — Sean D Andrish
(74) *Attorney, Agent, or Firm* — Dorsey & Whitney LLP

(57) ABSTRACT

A ground anchor system configured for introducing into a borehole, and comprising a plurality of straps each having a length dimension extending along a central longitudinal axis of the ground anchor system. Each of said straps has a width dimension taken along a major axis and a thickness dimension taken along a minor axis. The major axis and the minor axis are disposed at a transverse plane of the ground anchor system and intersect at a middle point. The middle point of each of said straps is intersected by an imaginary line extending through the longitudinal axis at the transverse plane. The imaginary line forms an angle smaller than 90° with the major axis of the respective strap.

19 Claims, 9 Drawing Sheets

(56) References Cited

U.S. PATENT DOCUMENTS

| | | | |
|---|---|---|---|
| 7,726,082 | B2 | 6/2010 | Hayes |
| 7,886,490 | B2 | 2/2011 | Maekawa |

FOREIGN PATENT DOCUMENTS

| | | | |
|---|---|---|---|
| EP | 1712685 | * | 10/2006 |
| EP | 2119846 | | 11/2009 |

OTHER PUBLICATIONS

International Search Report from International Application PCT/IL2014/050304 dated Jun. 30, 2014.
Sireg—Durglass®—Glasspree Brochure, available at least as of Jun. 29, 2016.

* cited by examiner

GROUND ANCHOR SYSTEM AND METHOD

TECHNOLOGICAL FIELD

The presently disclosed subject matter is in the field of ground anchoring systems and methods, and more particularly in the field of ground anchoring systems using straps.

BACKGROUND

A ground anchor system is designed to support a structure (e.g., ground) and is typically used in geotechnical applications. Ground anchor systems consisting of tendons (e.g., cables or rods) connected to a bearing plate are often used for the stabilization of steep slopes or slopes consisting of softer soils, as well as the enhancement of embankment or foundation soil capacity, or to prevent excessive erosion and landslides. Ground anchor systems can hold the walls and posts of outdoor structures to the ground without a foundation or concrete-filled post holes. The strength of the ground anchor's grip is largely determined by the consistency of the site's soil.

Ground anchor systems can be used in either temporary or permanent applications. Typical use for ground anchor systems includes supporting retaining walls.

Although most typically made of metallic materials, the tendons of ground anchor systems can be made of fiber-reinforced polymer (FRP), and can have a flat and an elongated shape. FRP is a composite material made of a polymer matrix reinforced with fibers. The fibers are usually glass, carbon, basalt or aramid, although other fibers such as paper or wood or asbestos are sometimes used.

In particular, it is appreciated that the tendons of ground anchor systems can be made of carbon-fiber-reinforced polymer, carbon-fiber-reinforced plastic or carbon-fiber-reinforced thermoplastic (CFRP, CRP, CI-RTP or often simply carbon fiber, or even carbon), which are extremely strong and light fiber-reinforced polymers which contain carbon fibers.

CFRP straps are characterized by light weight, corrosion resistant, and can be easily trimmed or cut if required. Due to these characteristics, CFRP are highly suitable for offshore environments and crowded construction areas.

An example for a ground anchor system can be found in EP 726383, which discloses a device for reinforcement, consolidation and stabilization of the ground, particularly for preventing landslides or deformation of the working face in tunnels or trenches, comprising an injection tube, advantageously with valves, to be inserted in a respective borehole in the ground, around which tube are arranged a plurality of strong reinforcing elements, mounted by means of centering spacers and held together by external retaining elements. According to a particular example disclosed in EP 726383, the tendons are made of glass fiber bars, composed by parallel and continuous glass fibers embedded in a polymer matrix. The use of this material has recently become wide in the field of geotechnical and civil engineering, due to its characteristics. These characteristics include, for example, high tensile strength (twice that of standard steel), corrosion resistance, lightweight, thermal insulation, magnetic insulation and electric insulation.

GENERAL DESCRIPTION

According to a first aspect of the present subject matter, there is provided a ground anchor system configured for introducing into a borehole, and comprising a plurality of straps each having a length dimension extending along a central longitudinal axis of the ground anchor system, each of said straps having a width dimension taken along a major axis and a thickness dimension taken along a minor axis, said major axis and said minor axis being disposed at a transverse plane of the ground anchor system and intersect at a middle point; wherein said middle point of each of said straps being intersected by an imaginary line extending through the longitudinal axis at said transverse plane, said imaginary line forms an angle smaller than 90° with the major axis of the respective strap.

The term 'strap' refers to a substantially narrow usually flat elongated tendon or strip, the length of which can be increased upon axial tensioning. The straps have a cross-section area having a geometrical shape which can be symmetric, such as: a rectangular shape, a square shape, an oval shape or an elliptic shape.

According to a second aspect of the presently disclosed subject matter, there is provided a ground anchor system configured for introducing into a borehole, and comprising a plurality of straps each having a length dimension extending along a central longitudinal axis of the ground anchor system, each of said straps having a width dimension and a thickness dimension smaller than said width dimension, said width dimension and said thickness dimension being taken at a transverse plane of the ground anchor system; said width dimension being defined between an innermost edge of a strap and an outermost edge thereof, and the innermost edge of said straps being disposed closer to the longitudinal axis than the outermost edge.

The term 'edge' refers hereinafter to an extremity point of a cross section of the strap disposed on a major axis thereof.

According to a third aspect of the present subject matter there is provided a method for assembling a ground anchor system, comprising:

(a) providing a plurality of straps each having a length dimension, a width dimension taken along a major axis and a thickness dimension taken along a minor axis smaller than said width dimension, said major axis and said minor axis being taken at a transverse plane of the ground anchor system and intersect at a middle point; and (b) disposing said straps along a central longitudinal axis of the ground anchor system so that said length dimension extending along the longitudinal axis and in such a manner that the middle point of each strap being intersected by an imaginary line extending through the longitudinal axis at said transverse plane, said imaginary line forms an angle smaller than 90° with the major axis of the respective strap.

According to a fourth aspect of the present subject matter there is provided a method for assembling a ground anchor system, comprising:

(a) providing a plurality of straps each having a length dimension, a width dimension and a thickness dimension smaller than said width dimension, said width dimension and said thickness dimension being taken at a transverse plane of the ground anchor system, the width dimension being defined between an innermost edge of a strap and an outermost edge thereof; and (b) disposing said straps along a central longitudinal axis of the ground anchor system so that said length dimension extending along the longitudinal axis and in such a manner that the innermost edge of said straps is disposed closer to the longitudinal axis than the outermost edge.

The arrangement of the straps according to the above aspects, allows increasing the number of straps to be accommodated within a borehole with a given diameter, such as: an arrangement according to which each of the straps is disposed so that its major axis forms an angle of 90° with its respective imaginary line; or an arrangement according to which the innermost edge and the outermost edge of the straps are equally spaced from the longitudinal axis. The increase in the number of straps to be accommodated within a borehole with a given diameter allows increasing the tensile strength which the entire ground anchor system is able to withstand in the given borehole.

According to a fifth aspect of the present subject matter there is provided a pre-stressing system for use in conjunction with a ground anchor system, according to the above first and second aspects.

The pre-stressing system is a so-called wedging device comprising a wedging-ring configured with an cylindrical bore tapering along a longitudinal axis thereof, and a plurality of sectored wedges, each configured with two side walls and an arched wall, wherein the side walls extend substantially parallel to a longitudinal axis and the arched wall axially tapers substantially equal to that of the tapering cylindrical bore, and wherein when the sectored wedges are disposed within the wedging-ring a wedging gap extends between adjoining side walls of two neighboring sectored wedges, said wedging-gap configured for receiving its respective strap of said straps.

The pre-stressing system is configured for use with an axial tensioning mechanism, configured for applying axial, tensioning force on the straps, so as to tighten the clamping grip of the sectored wedges over the surface of the straps. According to a particular configuration, the straps of the ground anchor system are axially stressed using a single stressing mechanism (e.g. a hydraulic jack).

According to a sixth aspect of the present subject matter there is provided a method for applying a ground anchoring system into a borehole, the method comprising the following steps:

a) providing a ground anchor system configured for introducing into a borehole, and comprising a plurality of straps each having a length dimension extending along a central longitudinal axis of the ground anchor system, each of said straps having a width dimension taken along a major axis and a thickness dimension taken along a minor axis, said major axis and said minor axis being disposed at a transverse plane of the ground anchor system and intersect at a middle point; wherein said middle point of each of said straps being intersected by an imaginary line extending through the longitudinal axis at said transverse plane, said imaginary line forms an angle smaller than 90° with the major axis of the respective strap;

b) introducing the ground anchor system into the borehole in the ground, such that free ends of the straps extend from a surface of the ground;

c) applying a grouting agent into the borehole and allowing the grouting agent to cure, thereby fixing the ground anchor system to the borehole;

d) mounting a pre-stressing system over said free ends of the straps;

e) axially stressing the straps; and f) disassembling the pre-stressing system from the straps while preserving them in a stressed position.

Any one or more of the features, designs and configurations below can be incorporated in any one or more of the aspects of the presently disclosed subject matter, independently or in combinations thereof.

The straps can be equally spaced from the longitudinal axis.

The straps can be disposed in a star polygon fashion, such as: a Y-like shape in case of three straps, a +-like shape in case of four straps, a *-like shape in case of five straps.

The straps can be disposed symmetrically with respect to the longitudinal axis.

The straps can be disposed substantially equally angularly with respect to each other.

The cross sectional area of the straps at the transverse plane can have a rectangular shape.

The straps can be made of a composite material made of a polymer matrix reinforced with fibers, i.e., a fiber-reinforced polymer (FRP). The fibers can be made of glass, carbon, basalt or aramid, although other fibers such as paper or wood or asbestos are sometimes used. Alternatively, the straps can be made metallic materials.

The straps can be of carbon-fiber-reinforced polymer, carbon-fiber-reinforced plastic or carbon-fiber-reinforced thermoplastic (CFRP, CRP, CFRTP or often simply carbon fiber, or even carbon), which are extremely strong and light fiber-reinforced polymers which contain carbon fibers.

The straps can also be made of glass fiber bars, composed by parallel and continuous glass fibers embedded in a polymer matrix.

The width dimension can be smaller than a radius of an inscribed circle of the borehole in which the system is introduced.

The ground anchor system can comprise at least one grouting tube configured for applying a grouting agent into the borehole, said grouting tube extending along the longitudinal axis.

According to the first and the third aspects, the width dimension can be defined between an innermost edge of a strap and an outermost edge thereof, and the innermost edge of said straps can be disposed closer to the longitudinal axis than the outermost edge.

According to the second and the fourth aspects, the width dimension taken along a major axis and the thickness dimension taken along a minor axis, said major axis and said minor axis being disposed at a transverse plane of the ground anchor system and intersect at a middle point; wherein said middle point of each of said straps being intersected by an imaginary line extending through the longitudinal axis at said transverse plane, said imaginary line forms an angle smaller than 90° with the major axis of the respective strap The width dimension of the straps can coextend with said imaginary lines.

The width dimension can be smaller than a radius of an inscribed circle of the borehole.

The innermost edges of the straps can define a central gap therebetween, and the longitudinal axis can extend substantially coaxially with the central gap.

The grouting tube can be disposed along the central gap.

The ground anchor system can comprise one or more spacer-discs configured for retaining the straps at their orientation.

The spacer-discs can comprise at least one central grouting aperture configured for allowing passage of the grouting tube therethrough.

The ground anchor system can comprise at least one anchor sleeve configured for accommodating said straps therein.

The method of the third and the fourth aspects can comprise a step of disposing the straps at an equal space from the longitudinal axis.

The method of the third and the fourth aspects can further comprise a step of disposing the straps in a star polygon fashion.

The method of the third and the fourth aspects can further comprise a step of disposing the straps symmetrically with respect to the longitudinal axis.

The method of the third and the fourth aspects can further comprise a step of disposing the straps substantially equally angularly with respect to each other.

The straps can be disposed at radial orientations, e.g., extending along a radius of the wedging device.

The sectored wedges of the wedging device can be made of hard material, such as metal.

At least portions of surfaces of the side walls of the sectored wedges can be configured with a friction increasing arrangement, such as roughening, knurling, applying a friction-increasing substance, etc.

The wedging device can accommodate lesser straps than the number of wedging gaps within the wedging device.

A flat dummy insert can be introduced into one or more wedging-gaps not occupied by a flat tendon, so as to retain respective radial positioning of the sectored wedges.

A central gap can extend between innermost edges of the flat tendons, said central gap extending substantially coaxially between the sectored wedges within the wedging-ring, i.e. between the vertexes of the sectored wedges.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figure 1B:
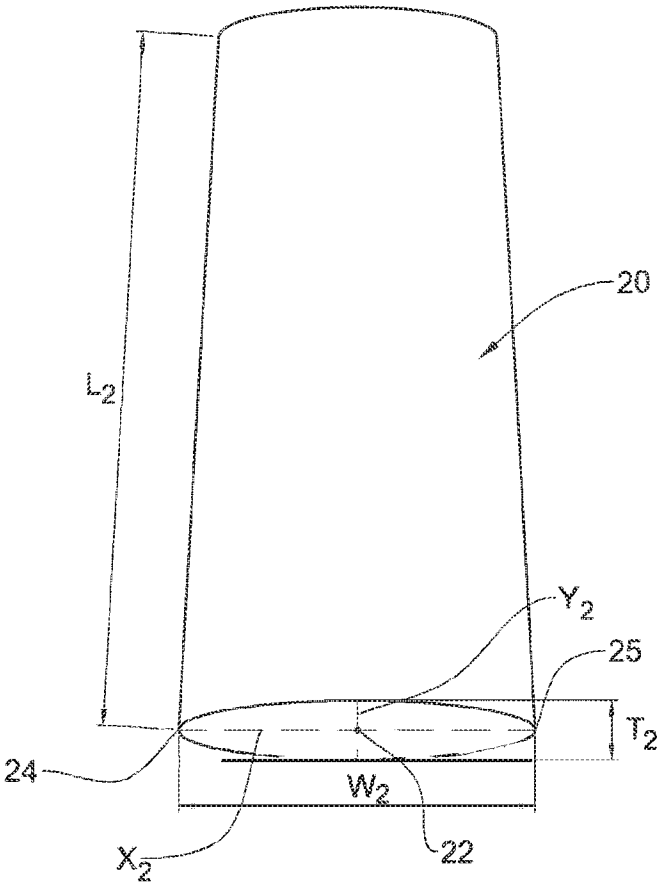
Fig. 1B (PRIOR ART)
FIG. 1B is a perspective view of a strap having a cross section with an oval shape, configured for use in conjunction with a ground anchor system according to the prior art.
Figure 1A:
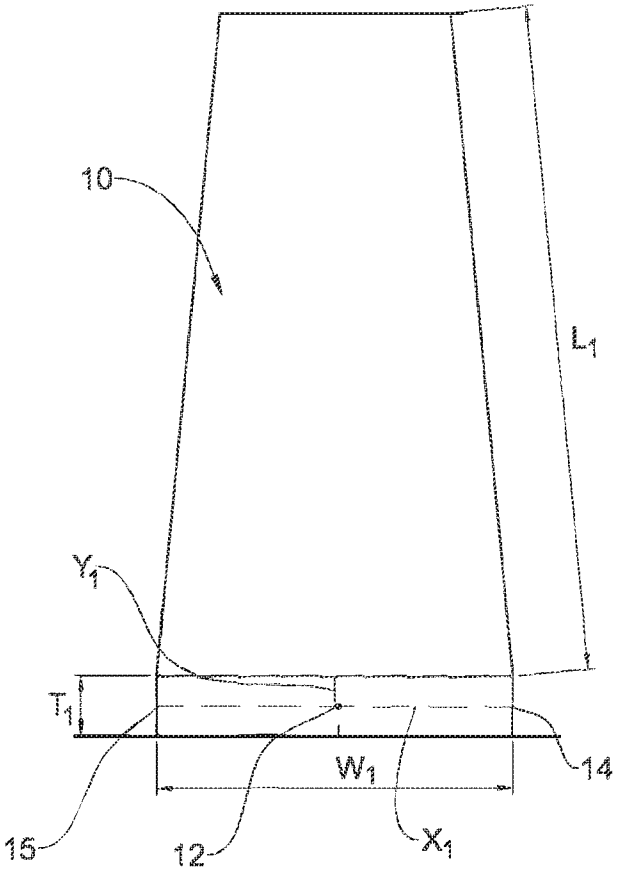
Fig. 1A (PRIOR ART)
FIG. 1A is a perspective view of a strap having a cross section with a rectangular shape, configured for use in conjunction with a ground anchor system according to the prior art.

Attention is first directed to FIGS. 1A and 1B of the drawings, illustrating a perspective view of two example of known in the art straps, generally designated 10 and 20, configured for use in conjunction with a ground anchor system. The straps 10 and 20 are flat tendons made of a polymeric material. In particular, the straps 10 and 20 are made of Carbon Fiber Reinforced Polymers (CFRPs), belonging to a group of Fiber Reinforced Polymers (FRPs) and composites thereof. The CFRPs are used in the field of ground anchoring since they are able to bear high axial loads, to resist to corrosion (as opposed to metal tendons) and to be easily trimmed or cut when required.

As seen in the drawings, the straps 10 and 20 are examples of flat tendons having a different cross-sectional shape, as detailed below.

As seen in FIG. 1A, the strap 10 has a length dimension $L_1$, a width dimension $W_1$ and a thickness dimension $T_1$, so that $L_1 >> W_1 > T_1$. The strap 10 is substantially straight along its length dimension $L_1$. The width dimension $W_1$ and thickness dimension $T_1$ refer to dimensions of a cross section of the strap 10, taken at a plane that is transverse to an axis along which the length dimension $L_1$ is taken. The cross section of the strap 10 is characterized by a major axis $X_1$ and a minor axis $Y_1$, being perpendicular to each other. The cross section of the strap 10 has a rectangular shape. The width dimension $W_1$ is taken along the major axis $X_1$ between an innermost edge 14 and an outermost edge 15 and the thickness dimension $T_1$ is taken along the minor axis $Y_1$. The major axis $X_1$ is centered with respect to the thickness dimension $T_1$, and the minor axis $Y_1$ is centered with respect to the width dimension $W_1$. The major and the minor axes $X_1$ and $Y_1$ intersect at a middle point 12.

As seen in FIG. 1B, the strap 20 that is shown from a perspective view, has a length dimension $L_2$, a width dimension $W_2$ and a thickness dimension $T_2$, so that $L_2 >> W_2 > T_2$. The strap 20 is substantially straight along its length dimension $L_2$. The width dimension $W_2$ and thickness dimension $T_2$ refer to dimensions of a cross section of the strap 20, taken at a plane that is transverse to an axis along which the length dimension $L_2$ is taken. The cross section of the strap 20 is characterized by a major axis $X_2$ and a minor axis $Y_2$, being perpendicular to each other. The cross section of the strap 20 has an oval shape. The width dimension $W_2$ is taken along the major axis $X_2$ between an innermost edge 24 and an outermost edge 25 and the thickness dimension $T_2$ is taken along the minor axis $Y_2$. The major axis $X_2$ is centered with respect to the thickness dimension $T_2$, and the minor axis $Y_2$ is centered with respect to the width dimension $W_2$. The major and the minor axes $X_2$ and $Y_2$ intersect at a middle point 22.

Figure 1D:
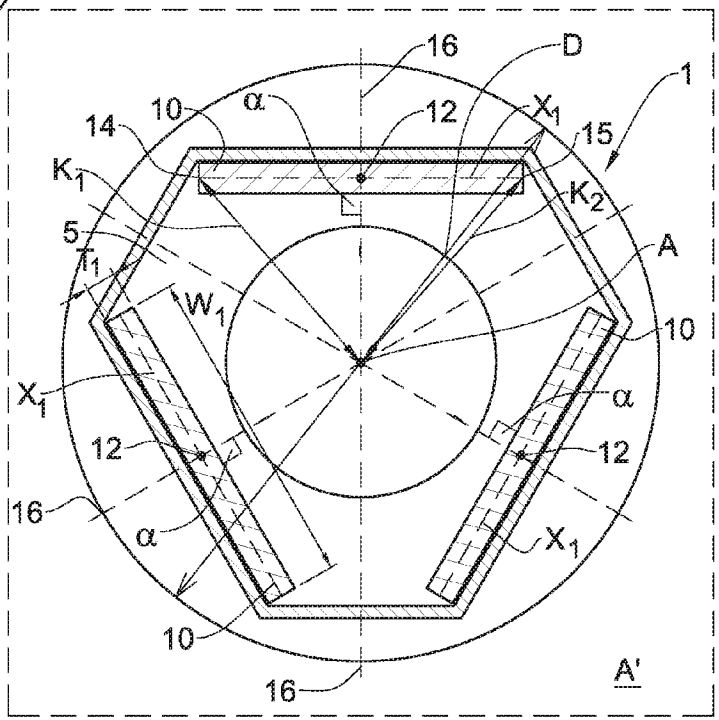
Fig. 1D (PRIOR ART)
FIG. 1D is a cross sectional view taken along line I-I in FIG. 1C, with the upper strap connected to the ground anchor system.
Figure 1C:
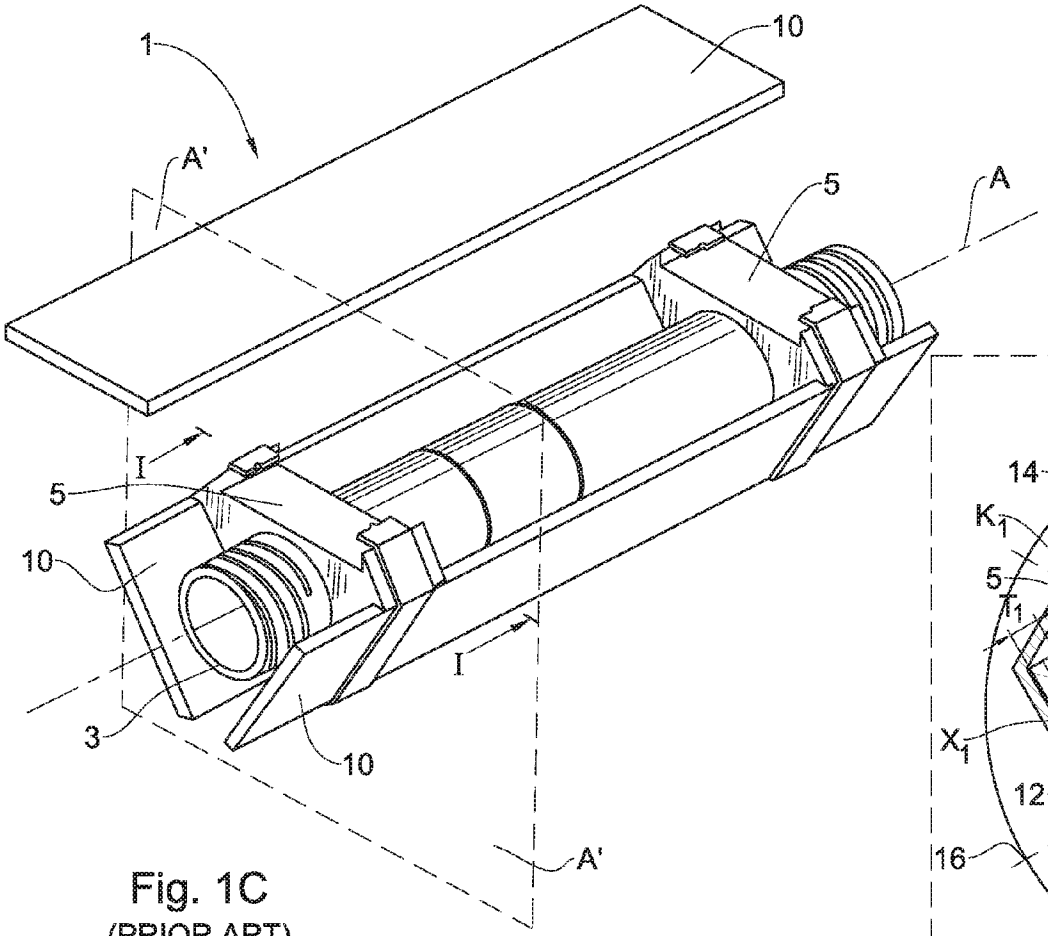
Fig. 1C (PRIOR ART)
FIG. 1C is an isometric view of a ground anchor system known in the art in which one of the straps is disconnected from the ground anchor system for illustration purposes.

Attention is now directed to FIGS. 1C and 1D of the drawings, illustrating a known in the art ground anchor system 1 having a longitudinal axis A and a transverse plane A', being perpendicular thereto. The ground anchor system 1 comprises: three of the straps 10, a central tube 3 and spacers 5. The straps 10 are positioned in the ground anchor system 1 in accordance with a specific orientation with respect to each other, as detailed below.

The three straps 10 extend along the longitudinal axis A and are radially disposed with respect thereto. The straps 10 are mounted on the central tube 3 by the spacers 5.

As can be seen in FIG. 1D, each one of the straps 10 is disposed in such a manner that its middle point 12 is intersected by an imaginary line 16, extending through the longitudinal axis A at the transverse plane A'. Each one of the imaginary lines 16 forms with the major axis $X_1$ of the respective strap 10 an angle $\alpha$ that is equal to 90°.

It is further seen in FIG. 1D that a distance $K_1$, extending between the innermost edge 14 of the strap 10 and the longitudinal axis A is equal to the distance $K_2$, extending between the outermost edge 15 of the strap 10 and the longitudinal axis A.

Reference is now made to the ground anchor system 1 of FIG. 1D in order to explain its limitations with respect to a particular example of straps and borehole having particular dimensions. As can be seen in FIG. 1D, the ground anchor system 1 is configured to be installed within a borehole having a diameter D which is equal to 110 mm. On the other hand, the width dimension $W_1$ of the strap 10 is equal 40 mm and the thickness dimension $T_1$ is equal to 9 mm. Each of the three straps 10 has a tensile strength of 360 KN. This means that the ground anchor system 1 is configured to withstand a tensile strength of 1,080 KN (3*360 KN). It is well known in the field of ground anchoring that sometimes there is a need to provide a ground anchor system which is able to withstand much higher tensile strength (e.g., 2,000 KN, 3,000 KN) for a given borehole (e.g., having a diameter D of 110 mm). In order to provide such a system, it is possible to use straps having other characteristics (e.g., thickness, width, structure, material, etc.), but this can be expensive or even non-feasible. Alternatively, it is possible to increase the number of the straps within the system. However, the arrangement of the straps within the system, such as the arrangement of FIGS. 1C and 1D, would limit or even not allow that.

This problem can be solved by arranging the straps in accordance with a more compact arrangement as provided by the system of the presently disclosed subject matter, and as explained below with respect to particular examples.

Figure 2A:
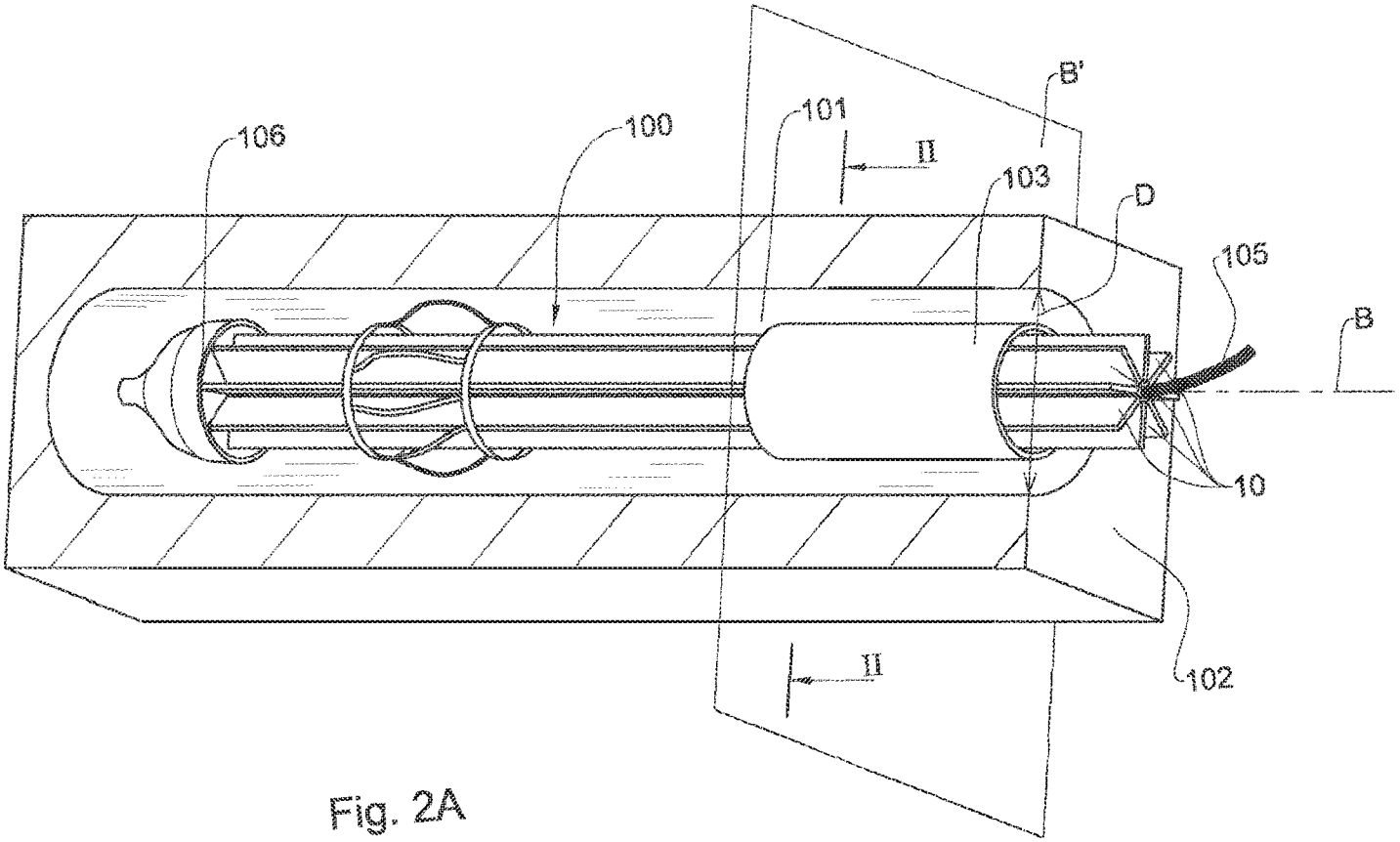
FIG. 2A is a perspective view of a ground anchor system according to one example of the presently disclosed subject matter.
Figure 2B:
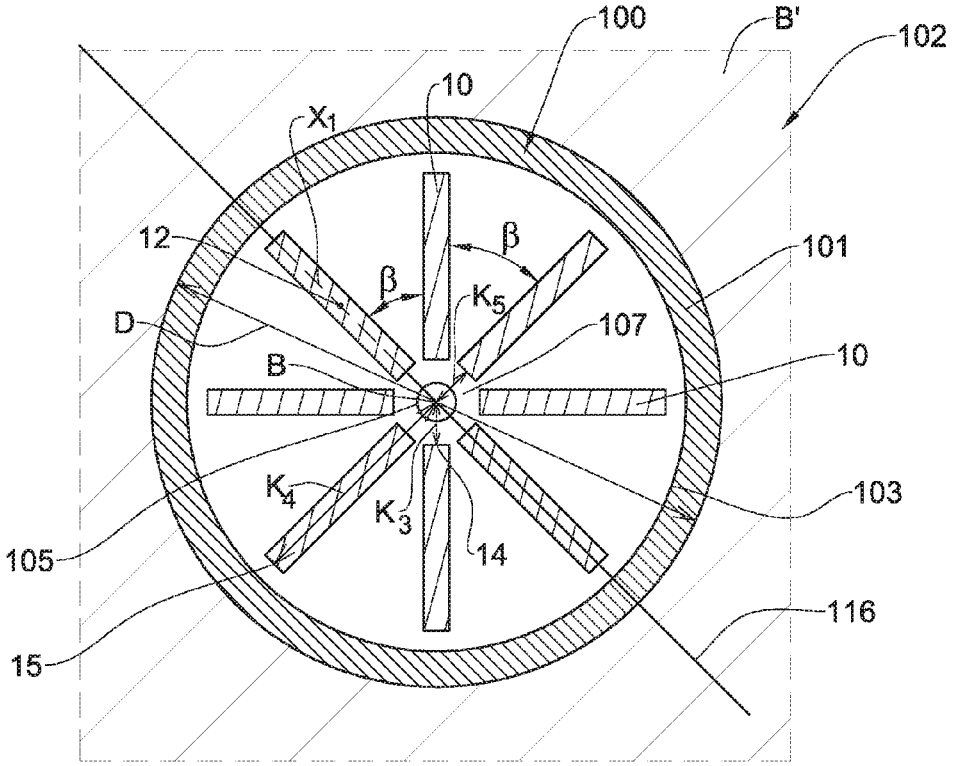
FIG. 2B is a cross sectional view, taken along line II-II in FIG. 2A.

Reference is now made to FIGS. 2A and 2B, illustrating an example of a ground anchor system 100 according to the presently disclosed subject matter.

The ground anchor system 100 is accommodated within a round borehole 101 having by a diameter D which is equal to 110 mm. The ground anchor system 100 is configured with eight of the straps 10, the length dimension of which extends along a central longitudinal axis B. The longitudinal axis B is perpendicular to a transverse plane B' of the system. The straps 10 are accommodated within a sleeve 103. As can be seen, free ends of the straps 10 extend from a surface 102 of the ground, while the remaining portions of the straps 10 are fully accommodated within the borehole.

The ground anchor system 100 comprises a grouting tube 105 extending along the longitudinal axis B. The grouting tube 105 has a distal end that is connected to a distributer 106. The grouting tube 105 is configured to receive a grouting agent via its proximal end, and to deliver the grouting agent into the borehole 101 via the distributer 106. The grouting tube 105 is disposed along a central gap 107, best seen in FIG. 2B, which is defined by the innermost edges 14 of the straps 10, and extends substantially coaxially with the longitudinal axis B.

Figure 3:
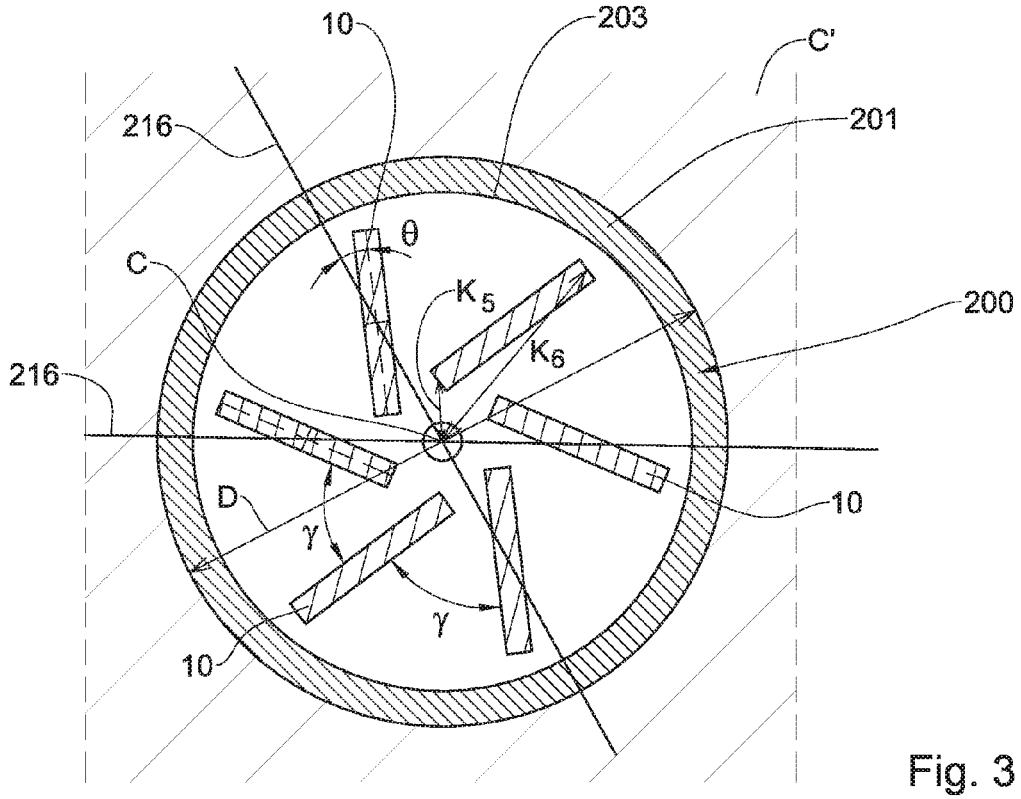
FIG. 3 is a cross sectional view of a ground anchor system according to another example of the presently disclosed subject matter.

As aforementioned, one of the alternatives for increasing the tensile strength of a ground anchor system is by increasing the number of the straps within the system. Since the system is configured for introducing into a given borehole with a given diameter D, its external dimensions have to be preserved while straps are added thereto. Increasing the number of straps, without changing the external dimensions of the system can be obtained by the arranging the straps within the system in a different and more compact manner. One example of such an arrangement is shown in FIGS. 2A and 2B, and another example, is shown in FIG. 3, the description of which is provided below.

Reference is now made to FIG. 2B, in which the disposition of the straps 10 within the system and their orientation with respect to the longitudinal axis B is shown.

The straps 10 are radially disposed with respect to the longitudinal axis B and radially extend therefrom. According to the present example, the straps 10 are disposed in a star polygon fashion, and in particular of a star polygon having eight vertices, wherein each one of the straps 10 is associated with its respective vertex of the star polygon. According to other examples, the ground anchor system can be provided with a different number of the straps 10, which are disposed in a star polygon fashion, i.e.: a Y-like shape in case of three straps, a +-like shape in case of four straps, a ★-like shape in case of five straps, etc. The straps 10 are equally spaced from the longitudinal axis B so that the innermost edge 14 of each strap is disposed closer to the longitudinal axis B than its outermost edge 15. According to this arrangement, the innermost edge 14 of each one of the straps 10 is distant from the longitudinal axis B to a distance $K_3$ and the outermost edge 15 is distant from the longitudinal axis B to a distance $K_4$ ($K_3<K_4$). In addition, the straps 10 are disposed symmetrically with respect to the longitudinal axis B, and equally angularly with respect to each other, with an angle β therebetween. In the specific example of eight straps 10, the angle β is equal to 45°, but can vary depending on the number of straps 10, according to the formula 360/n, for a system having n of the straps 10.

As can further be seen in FIG. 2B, each one of the middle points 12 of the straps 10 is intersected by an imaginary line 116 that extends through the longitudinal axis B. The imaginary lines 116 extend at the plane B' and are provided for explaining the angular orientation of the straps 10 within the ground anchor system 100.

The arrangement of the straps 10 is such that the imaginary lines 116 coextend with their major axis $X_1$ so that the angle of 0° is formed therebetween.

The arrangement of the straps according to the example of FIGS. 2A and 2B provided a ground anchor system with eight of the straps 10. Since each one of the straps 10 has a tensile strength of 360 KN, the entire system can withstand a tensile strength of 2,880 KN (8*360 KN). While the ground anchor system 100 is able to withstand such a tensile strength, it still can be mounted within a borehole having a diameter D of 110 mm.

Referring now to FIG. 3, which is a cross section of another example of a ground anchor system according to the presently disclosed subject matter, generally designated 200. A perspective view of the ground anchor system 200 is not presented in the drawings. The ground anchor system 200 includes an arrangement of the straps 10 in accordance with the general concept of the presently disclosed subject matter, as detailed below.

Similarly to ground anchor system 100, the ground anchor system 200 is accommodated within a substantially round borehole generally designated 201 and characterized by a diameter D. Furthermore, the ground anchor system 200 has components that are similar to those of the ground anchor system 100, but has another arrangement of straps therein.

The ground anchor system 200 is configured with six of the straps 10, the length dimension of which extends along a central longitudinal axis C. The longitudinal axis C is perpendicular to a transverse plane C' of the system. The straps 10 are accommodated within a sleeve 203.

The straps 10 of FIG. 3 are equally spaced from the longitudinal axis C so that the innermost edge 14 of each strap is disposed closer to the longitudinal axis C than its outermost edge 15. According to this arrangement, the innermost edge 14 of each one of the straps 10 is distant from the longitudinal axis C to a distance $K_5$ and the outermost edge 15 is distant from the longitudinal axis C to a distance $K_6$ ($K_5<K_6$). In addition, the straps 10 are disposed symmetrically with respect to the longitudinal axis C, and equally angularly with respect to each other, with an angle γ therebetween. In the specific example of six straps 10, the angle γ is equal to 60°.

As can further be seen in FIG. 3, each one of the middle points 12 of the straps 10 is intersected by an imaginary line 216 that extends through the longitudinal axis C. The imaginary lines 216 extend at the plane C' and are provided for explaining the angular orientation of the straps 10 within the ground anchor system 200.

The arrangement of the straps 10 in FIG. 3 is such that the each one of the imaginary lines 216 forms an acute angle θ, i.e. an angel smaller than 90°.

It is appreciated that the example of FIG. 3 is a general example of an arrangement of the straps 10, which allows increasing the number of the straps within the system 10, while preserving the external dimensions of the system.

According to example, the angle θ can vary within a spectrum of all acute angles, i.e. can be any angle smaller than 90°, in accordance with the engineering requirements of the system, e.g., the tensile strength of the system.

The arrangement of the straps according to the example of FIG. 3 provided a ground anchor system with six of the straps 10. Since each one of the straps 10 has a tensile strength of 360 KN, the entire system can withstand a tensile strength of 2,160 KN (6*360 KN). While the ground anchor system 200 is able to withstand such a tensile strength, it still can be mounted within a borehole having a diameter D of 110 mm.

The ground anchor systems 100 and 200 can be assembled in accordance with a method of the presently disclosed subject matter, which can be performed prior to applying it into the borehole, and can be performed at a construction site or at any other location remote therefrom.

The method for assembling the ground anchor system 100 includes at least the following steps:

providing eight of the straps 10; and disposing the straps 10 so that their major axis $X_1$ coextends with the imaginary line 116 and their innermost edge 114 is distant from the longitudinal axis B to the distance $K_3$.

The method for assembling the ground anchor system 200 includes at least the following steps:

providing eight of the straps 10; and disposing the straps 10 so that their major axis $X_1$ coextends with the imaginary line 216 and their innermost edge is distant from the longitudinal axis B to the distance $K_5$.

Figure 4A:
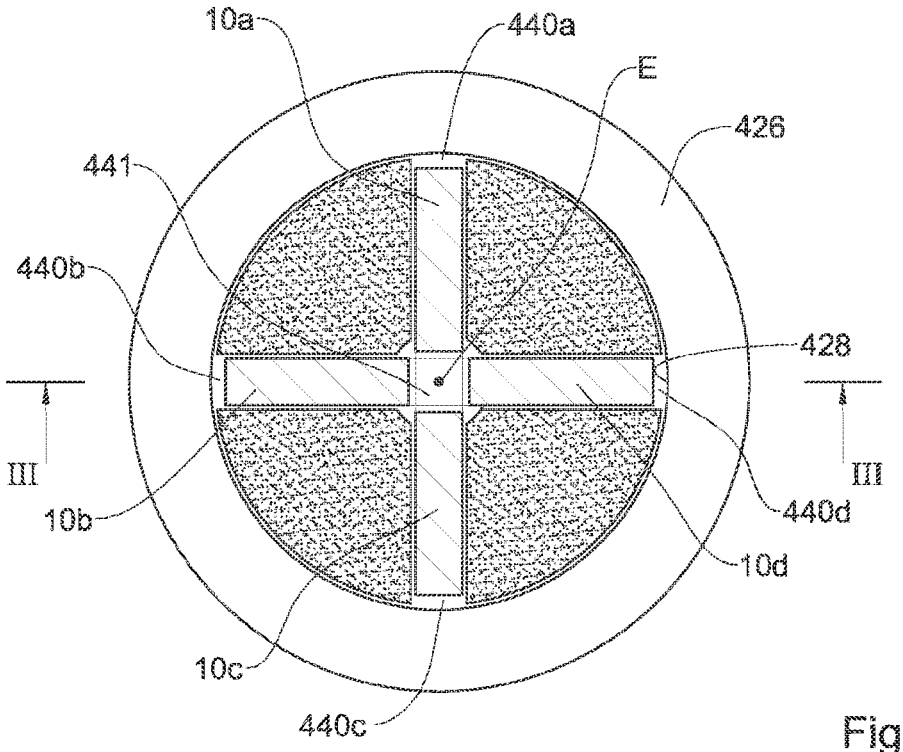
FIG. 4A is a front view of a wedging device according to an aspect of the present disclosure, the wedging device configured with four straps.
Figure 4B:
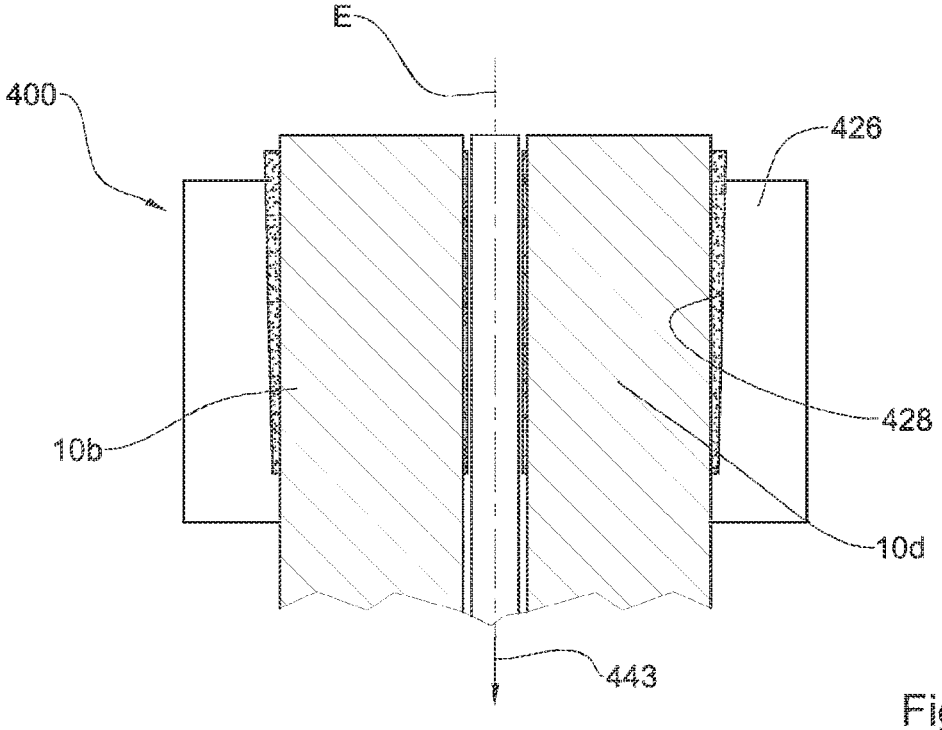
FIG. 4B is a sectioned planner view taken along line in FIG. 4A.
Figure 5:
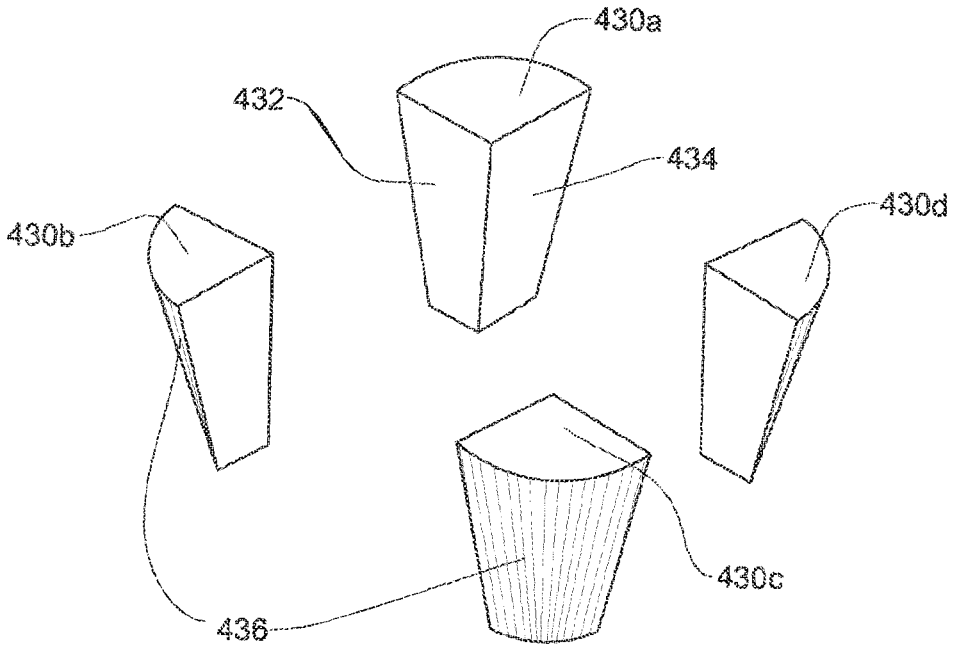
FIG. 5 is an exploded perspective view of the sectored wedges of the wedging device of FIGS. 4A and 4B.

Referring now to FIGS. 4A and 4B, illustrating a wedging device 400, configured for use in conjunction with the ground anchor system according to the presently disclosed subject matter. The wedging device 400 comprises a wedging-ring 426 (typically made of steel) configured with a cylindrical bore 428 tapering along a longitudinal axis E thereof. The wedging device 400 further comprises a plurality of sectored wedges typically made of steel (four in the illustrated example; designated 430*a*, 430*b*, 430*c* and 430*d*; said sectored wedges best seen in FIG. 5), each configured with two side walls 432 and 434, and an arched wall 436. The arrangement is such that the side walls 432 and 434 extend substantially parallel to the longitudinal axis D and the arched walls 436 axially taper at an extent similar to the tapering cylindrical bore 428.

Accordingly, when the sectored wedges 430*a*, 430*b*, 430*c* and 430*d* are disposed within the wedging-ring 426 four wedging-gaps 440*a*, 440*b*, 440*c* and 440*d* extend between adjoining side walls 432 and 434 of two neighboring sectored wedges 430*a*, 430*b*, 430*c* and 430*d*, respectively. The wedging-gaps 440*a*, 440*b*, 440*c* and 440*d* are each configured, as far as size and shape, for receiving a strap 10 radially disposed therein, said straps designated 10*a*, 10*b*, 10*c* and 10*d*, respectively.

As can best be seen in FIG. 4A, the straps 10*a*, 10*b*, 10*c* and 10*d* are disposed at a radial orientation, i.e. extending along the radius of the wedging device 400. Furthermore, the sectored wedges 430*a*, 430*b*, 430*c* and 430*d*, and likewise the straps, are disposed symmetrically within the wedging device 400, i.e. are substantially equally angularly disposed therein. As a result of the structure disclosed, a central gap 441 extends between innermost edges of the straps, said central gap 441 extending substantially coaxially along axis E between the sectored wedges within the wedging-ring, i.e. between the vertexes of the sectored wedges.

The arrangement is such that axial tensioning the straps designated 10*a*, 10*b*, 10*c* and 10*d* in direction of arrow 443 (FIG. 7D) whilst retaining the wedging device 400 or pulling it at a sense opposed to direction of arrow 443, results in clapping the sectored wedges 430*a*, 430*b*, 430*c* and 430*d* about the straps 10*a*, 10*b*, 10*c* and 10*d*, so as to prevent their detaching from the wedging device 400.

Figure 6:
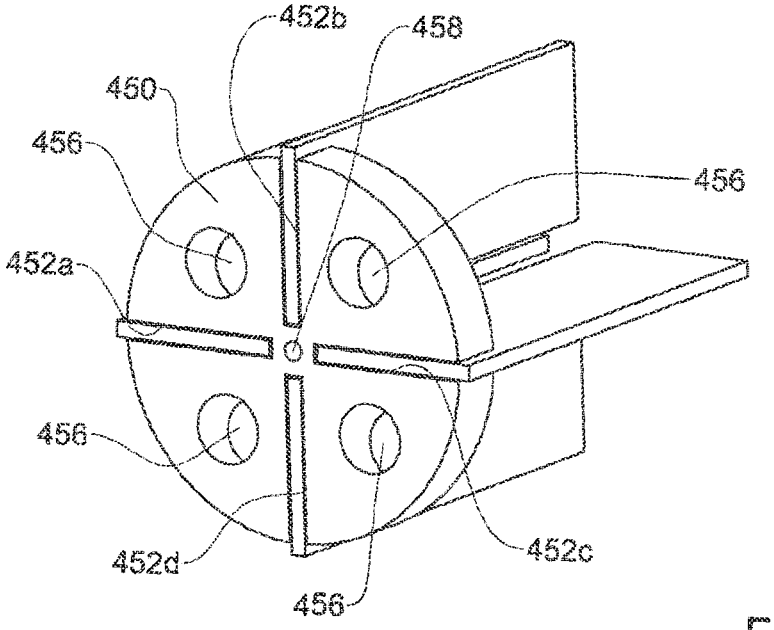
FIG. 6 is a perspective view of a spacer-disc used in conjunction with the presently disclosed subject matter.

FIG. 6 illustrates a spacer disk 450 used in conjunction with an anchoring system according to the present disclosure. The spacer disk 450 serves on the one hand for retaining the plurality of straps at their respective radially disposed position as discussed hereinabove, along the borehole into which the ground anchor system is introduced as will be hereinafter discussed with reference to FIGS. 7A to 7F, and on the other hand the spacer disk 450 facilitates flow of fluid grouting material therethrough, i.e. so as not to constitute a barrier for flow of the grouting agent throughout the entire depth of the bore of the ground anchor.

Spacer disk 450 is configured with a plurality (four in the particular example) of radially extending slots 452*a*, 452*b*, 452*c* and 452*d*, which when mounted in the ground anchor system (see hereinafter) are disposed substantially in register with the a four wedging-gaps 440*a*, 440*b*, 440*c* and 440*d* extending between neighboring sectored wedges 430*a*, 430*b*, 430*c* and 430*d*. The spacer disk 450 is further configured with a plurality of openings 456 and a central opening 458 (coinciding with the longitudinal axis E and with the central gap 441, facilitating flow of fluid grouting material therethrough.

As can further be seen in FIG. 6, the spacer-disc can have a diameter smaller than that of the circumcircle defined by the radially remote edges of the radially disposed straps 10*a*, 10*b*, 10*c* and 10*d*, such that fluid grouting agent can flow therethrough.

Turning now to FIGS. 7A to 7F, there are illustrated sequential steps of a method for applying a ground anchor system according to the present disclosure. It is however appreciated that the method is similar to methods performed insofar, with the exception of using ground anchor systems in accordance with the present disclosed subject matter, configured for use with radially disposed straps.

Figure 7A:
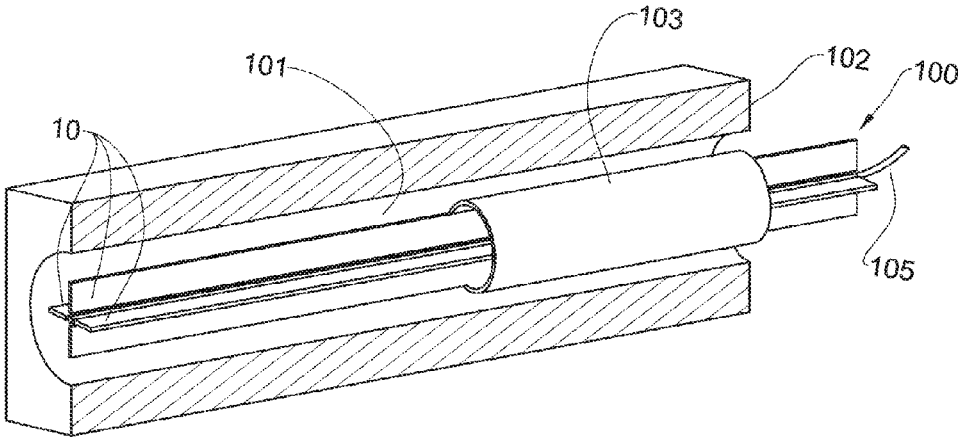
FIGS. 7A to 7F illustrate sequential steps of a method for applying a ground anchoring system according to the present disclosure.
Figure 7B:
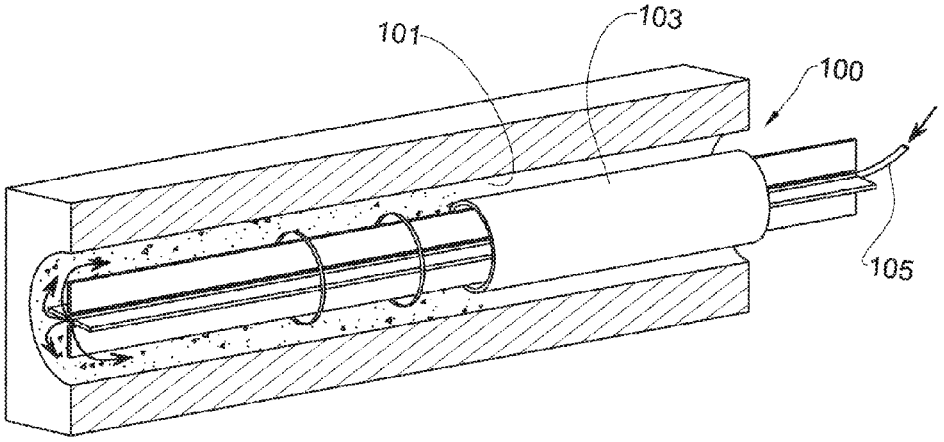
Figure 7D:
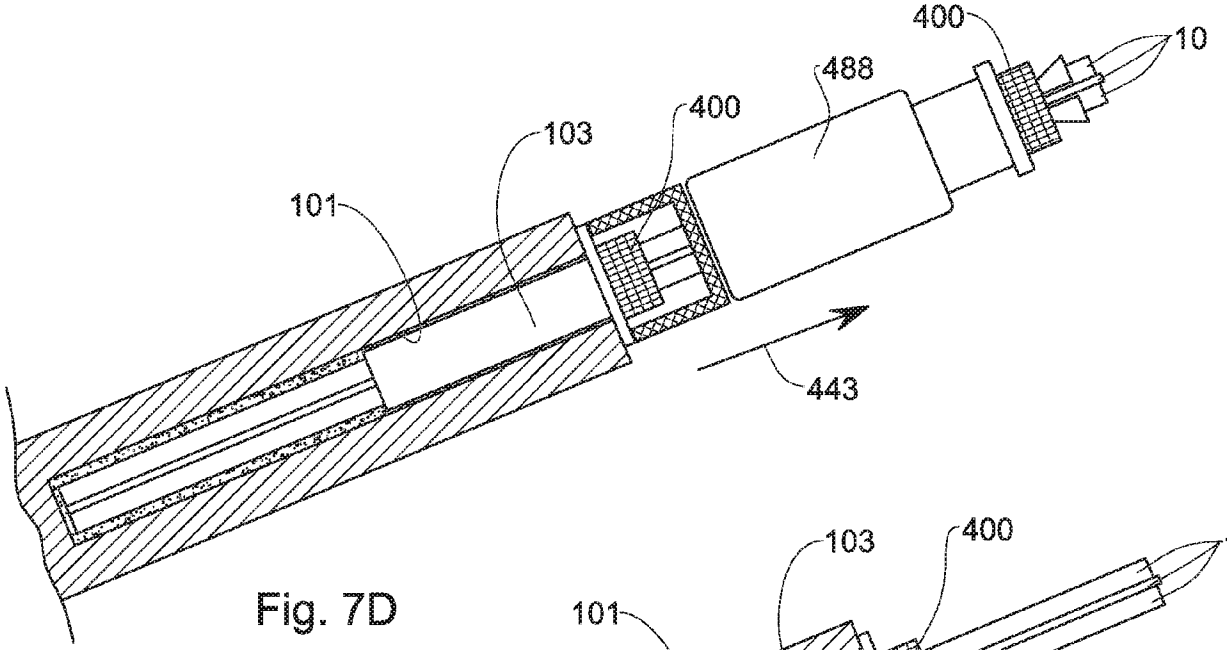
Figure 7C:
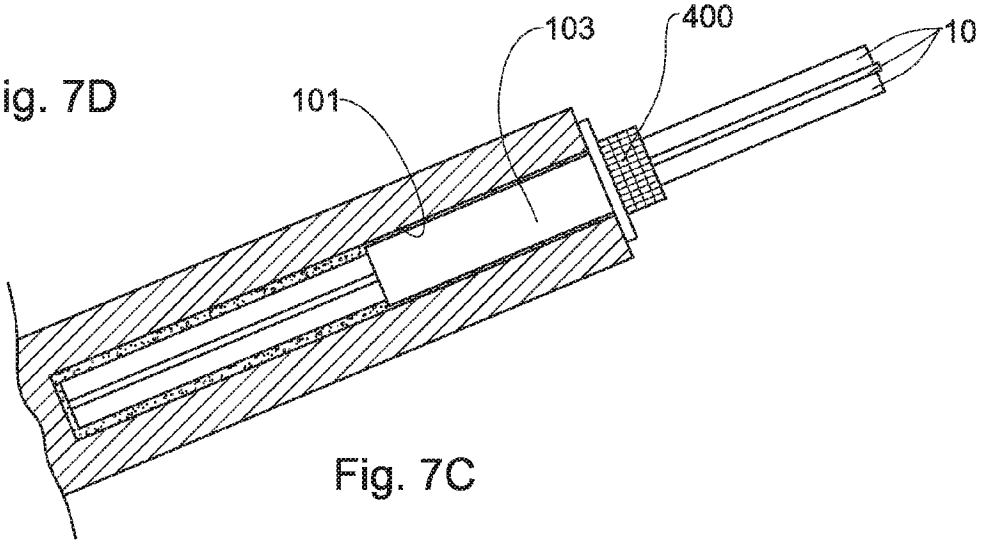
Figure 7E:
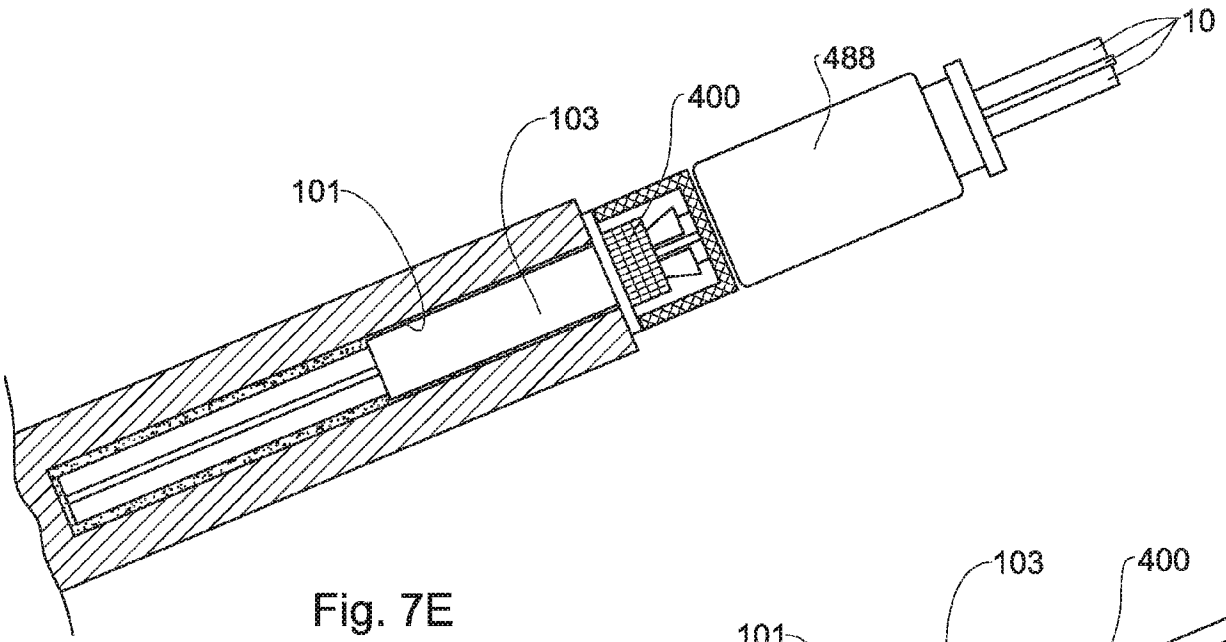
Figure 7F:
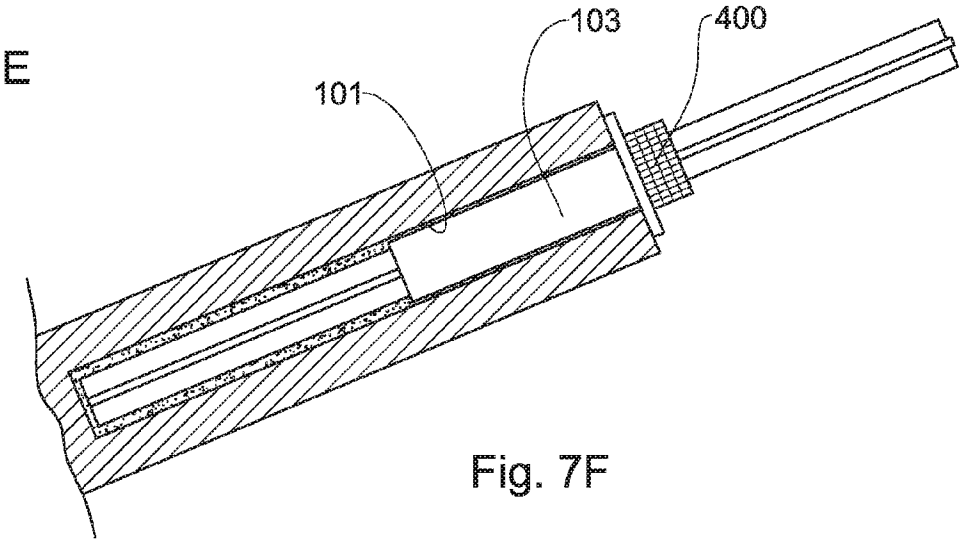

The method comprising the following steps:

a) providing a ground anchor system 100;

b) introducing the ground anchor system 100 into the borehole 101 in the ground, such that free ends of the straps 100 extend from a surface 102 of the ground (FIG. 7A);

c) applying a grouting agent into the borehole via the grouting tube 105 and allowing the grouting agent to cure, thereby fixing the ground anchor system 100 to the borehole 101 (FIG. 7B);

d) disposing a wedging device 400 over the free ends of the straps 10 (FIG. 7C).

e) mounting a pre-stressing system, e.g. tensioning mechanism such as jack 488, over said free ends of the straps 100 (FIG. 7D);

f) axially stressing the straps. In the illustrated example the axial stressing is performed by jack 488 (FIG. 7D);

g) mounting a second wedging device 400 according to the disclosure behind the tensioning mechanism 488 (FIG. 7D);

h) axially stressing the ground-anchor system as indicated by arrow 443 (FIG. 7D)

i) axially fixing the straps 10 by the second wedging device 400, allowing setting of the first wedging device 400 (FIG. 7E); and j) disassembling the pre-stressing system from the straps while preserving them in a stressed position.

The invention claimed is:

1. A ground anchor system configured to be introduced into a borehole, the ground anchor system comprising:

a plurality of straps each having a length dimension extending along a central longitudinal axis of the ground anchor system between a distal end and a proximal end, each of the plurality of straps having a width dimension taken along a major axis and a thickness dimension taken along a minor axis, the major axis and the minor axis being disposed at a transverse plane of the ground anchor system and intersect at a middle point; and an anchor sleeve configured for enveloping the plurality of straps therein;

wherein each of the plurality of straps includes the middle point intersected by an imaginary line extending through the longitudinal axis at the transverse plane, the imaginary line forms an angle smaller than 90° with the major axis of the respective strap; and wherein said anchor sleeve has a sleeve length that is shorter than said length dimension of the straps, so that when said anchor sleeve envelopes the straps, said distal ends of the plurality of straps are free of said anchor sleeve;

wherein said distal ends of the plurality of straps are laterally exposed to contact grout when said ground anchor system is installed in said borehole.

2. The ground anchor system according to claim 1, wherein said distal ends of the plurality of straps are configured for directly contacting a grouting agent when being at least partially grouted within the borehole.

3. The ground anchor system according to claim 1, wherein said proximal ends of the plurality of straps are free of said anchor sleeve to be axially stressed by a pre-stressing system after being at least partially grouted within the borehole.

4. The ground anchor system according to claim 1, wherein the plurality of straps are substantially equally spaced from the longitudinal axis.

5. The ground anchor system according to claim 1, wherein the plurality of straps are disposed substantially symmetrically with respect to the longitudinal axis.

6. The ground anchor system according to claim 1, wherein the plurality of straps are disposed substantially equally angularly with respect to each other.

7. The ground anchor system according to claim 1, wherein each of the plurality of straps at the transverse plane has a cross-sectional area exhibiting a rectangular shape.

8. The ground anchor system according to claim 1, wherein each of the plurality of straps are made of polymeric material.

9. The ground anchor system according to claim 1, wherein the width dimension is smaller than a radius of an inscribed circle of the borehole in which the ground anchor system is introduced.

10. The ground anchor system according to claim 1, wherein the width dimension is defined between an innermost edge and an outermost edge of each of the plurality of straps, and the innermost edge is disposed closer to the longitudinal axis than the outermost edge.

11. A ground anchor system configured to be introduced into a borehole, the ground anchor system comprising:

a plurality of straps each having a length dimension extending along a central longitudinal axis of the ground anchor system between a distal end and a proximal end, each of the plurality of straps having a width dimension and a thickness dimension smaller than the width dimension, the width dimension and the thickness dimension being taken at a transverse plane of the ground anchor system; and an anchor sleeve configured for enveloping the plurality of straps therein;

wherein the width dimension is defined between an innermost edge and an outermost edge of each of the plurality of straps;

wherein the innermost edge of each of the plurality of straps is disposed closer to the longitudinal axis than the outermost edge; and wherein said anchor sleeve has a sleeve length being shorter than said length dimension of the straps, so that when said anchor sleeve envelopes the straps, said distal ends of the plurality of straps are free of said anchor sleeve;

wherein said distal ends of the plurality of straps are laterally exposed to contact grout when said ground anchor system is installed in said borehole.

12. The ground anchor system according to claim 11, wherein said distal ends of the plurality of straps are configured for directly contacting a grouting agent when being at least partially grouted within the borehole.

13. The ground anchor system according to claim 11, wherein said proximal ends of the plurality of straps are free of said anchor sleeve to be axially stressed by a pre-stressing system after being at least partially grouted within the borehole.

14. The ground anchor system according to claim 11, wherein the innermost edges of the plurality of straps define a central gap therebetween, and the longitudinal axis extends substantially coaxially with the central gap.

15. The ground anchor system according to claim 11, wherein a middle point at the width dimension of each of the plurality of straps is intersected by an imaginary line extending through the longitudinal axis at the transverse plane, the imaginary line forms an angle smaller than 90° with the width dimension of the respective strap.

16. The ground anchor system according to claim 11, wherein the plurality of straps are substantially equally spaced from the longitudinal axis.

17. The ground anchor system according to claim 11, wherein the plurality of straps are disposed substantially symmetrically with respect to the longitudinal axis.

18. The ground anchor system according to claim 11, wherein the plurality of straps are disposed substantially equally angularly with respect to each other.

19. The ground anchor system according to claim 11, wherein each of the plurality of straps at the transverse plane has a cross-sectional area exhibiting a rectangular shape.

* * * * *